US010119559B1

(12) United States Patent
Powers et al.

(10) Patent No.: US 10,119,559 B1
(45) Date of Patent: Nov. 6, 2018

(54) FAIL-SAFE HYDRAULIC ACTUATOR WITH CONSTANT FORCE RETRACTION SPRINGS

(71) Applicant: LOCKHEED MARTIN CORPORATION, Bethesda, MD (US)

(72) Inventors: Joseph H. Powers, Bethesda, MD (US); Barry L. West, Bethesda, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 132 days.

(21) Appl. No.: 15/454,745

(22) Filed: Mar. 9, 2017

(51) Int. Cl.
*F01B 31/00* (2006.01)
*F15B 15/14* (2006.01)
*F15B 15/28* (2006.01)

(52) U.S. Cl.
CPC ..... *F15B 15/1476* (2013.01); *F15B 15/2861* (2013.01)

(58) Field of Classification Search
CPC ..... F15B 15/1476; F15B 15/2815; F15B 15/2861
USPC ..... 92/5 R, 132
See application file for complete search history.

(56) References Cited

U.S. PATENT DOCUMENTS 3,581,774 A 6/1971 Oeland, Jr. et al.
3,767,160 A 10/1973 McCollum
3,777,814 A 12/1973 Gustayson et al.
4,209,081 A 6/1980 Murro
4,480,811 A 11/1984 Card et al.
4,487,299 A 12/1984 Bookout
5,007,330 A 4/1991 Scobie et al.
5,449,047 A 9/1995 Schivley, Jr.
5,715,864 A 2/1998 Andel et al.
6,422,530 B1 7/2002 Williams, III
7,059,238 B2 * 6/2006 Albright ..... F15B 15/2815 92/5 R
8,413,774 B2 4/2013 Murakami
2011/0126912 A1 6/2011 Grimseth et al.

OTHER PUBLICATIONS

"Linear Transducers: Innovative Position Sensing Technology for Mobile Applications," published by Rota Engineering, Ltd. (Bury, Manchester, UK); Aug. 24, 2016; 9 pages.

* cited by examiner

*Primary Examiner* — Michael Leslie
(74) *Attorney, Agent, or Firm* — Hamre, Schumann, Mueller & Larson, P.C.

(57) ABSTRACT

A fail-safe hydraulic actuator that uses one or more constant force retraction springs to provide fail-safe retraction of the piston and piston rod in the event of loss of hydraulic pressure. The constant force retraction spring(s) can be packaged in a small volume thus decreasing the overall length of the actuator. This allows the actuator to be utilized in areas where length is a concern. The constant force retraction spring(s) are part of constant force retraction spring mechanism(s) that can be mounted within a hydraulic fluid cavity of the fail-safe hydraulic actuator to protect the constant force retraction spring mechanism(s) from the environment surrounding the actuator. A sensor that detects the linear position of the piston within the piston chamber may also be provided.

17 Claims, 3 Drawing Sheets

FAIL-SAFE HYDRAULIC ACTUATOR WITH CONSTANT FORCE RETRACTION SPRINGS

This invention was made with government support under a government contract. The government has certain rights in the invention.

FIELD

The described technology relates to a hydraulic actuator with a fail-safe retract feature that automatically retracts the piston and piston rod using constant force retraction springs during situations where hydraulic pressure is lost.

BACKGROUND

Certain applications of hydraulic actuators require the hydraulic actuators to fail-safe retract during situations where hydraulic pressure is lost. Previously, fail-safe retraction in a hydraulic actuator has been accomplished using a coil spring or a wave spring. However, the standard fail-safe spring that is used tends to be very large, which increases the total length of the hydraulic actuator since the actuator is sized to accommodate the spring travel as well as the solid height.

SUMMARY

A fail-safe hydraulic actuator is described that uses one or more constant force retraction springs to provide fail-safe retraction of the piston and piston rod in the event of loss of hydraulic pressure. The constant force retraction spring(s) can be packaged in a small volume thus decreasing the overall length of the actuator. This allows the actuator to be utilized in areas where length is a concern.

In one embodiment, the constant force retraction spring(s) is part of a constant force retraction spring mechanism(s) that can be mounted within a hydraulic fluid cavity of the fail-safe hydraulic actuator to protect the constant force retraction spring mechanism(s) from harsh environments, such as sea water, sand, and other contaminants. The constant force retraction spring(s) described herein can be any constant force spring construction in which the force it exerts over its range of motion is constant. In one embodiment, the constant force retraction spring(s) can be a rolled ribbon of spring steel or other material.

In another embodiment, the fail-safe hydraulic actuator can include a sensor that detects the linear position of the piston within the piston chamber.

In one embodiment, a fail-safe hydraulic actuator can include a housing having a first end and a second end and defining a piston chamber, and a piston assembly that includes a piston slidably disposed within the piston chamber and a piston rod connected to the piston and movable with the piston. The piston rod can have an end that extends through the first end of the housing. The housing can also include a hydraulic fluid cavity adjacent to the second end thereof, where the hydraulic fluid cavity is configured to contain a hydraulic fluid, and the hydraulic fluid cavity is in fluid communication with the piston chamber to allow passage of hydraulic fluid between the hydraulic fluid cavity and the piston chamber. In addition, at least one, for example first and second, constant force retraction spring mechanism(s) can be mounted within the hydraulic fluid cavity, where the one or more constant force retraction spring mechanisms can each include a constant force retraction spring having an end fixed to the piston assembly.

The constant force retraction spring(s) can bias the piston to a home or retracted position upon a loss in hydraulic pressure. In addition, by locating the one or more constant force retraction spring mechanisms within the hydraulic fluid cavity, the one or more constant force retraction spring mechanisms are protected from harsh environments such as sea water, sand, and other contaminants, that the hydraulic actuator is exposed to.

In still another embodiment, a fail-safe hydraulic actuator can include a housing having a first end and a second end and defining a piston chamber, and a piston assembly that includes a piston slidably disposed within the piston chamber and a piston rod connected to the piston and movable with the piston. The piston rod can have an end that extends through the first end of the housing. The housing can also include a hydraulic fluid cavity that is configured to contain a hydraulic fluid and that is in fluid communication with the piston chamber to allow passage of hydraulic fluid between the hydraulic fluid cavity and the piston chamber. In addition, one or more constant force retraction spring mechanisms are provided, where the one or more constant force retraction spring mechanisms can each include a constant force retraction spring having an end fixed to the piston on a side of the piston opposite of where the piston rod is connected to the piston. Further, a sensor is provided that detects the linear position of the piston within the piston chamber.

DRAWINGS

DETAILED DESCRIPTION

A fail-safe hydraulic actuator is described in detail below. In general, the fail-safe hydraulic actuator can include a piston assembly and at least one, for example two or more, constant force retraction spring mechanisms connected to the piston assembly to bias the piston assembly to a home or retracted position upon a loss in hydraulic pressure. In one embodiment, the constant force retraction spring mechanism(s) can be disposed within a sealed hydraulic fluid cavity to protect the constant force retraction spring mechanism(s) from the surrounding environment. In addition, as also described further below, the fail-safe hydraulic actuator can also include a sensor that detects the linear position of a piston of the piston assembly within a piston chamber. The fail-safe hydraulic actuator can have numerous specific constructions suitable for implementing the various embodiments described herein.

Figure 1:
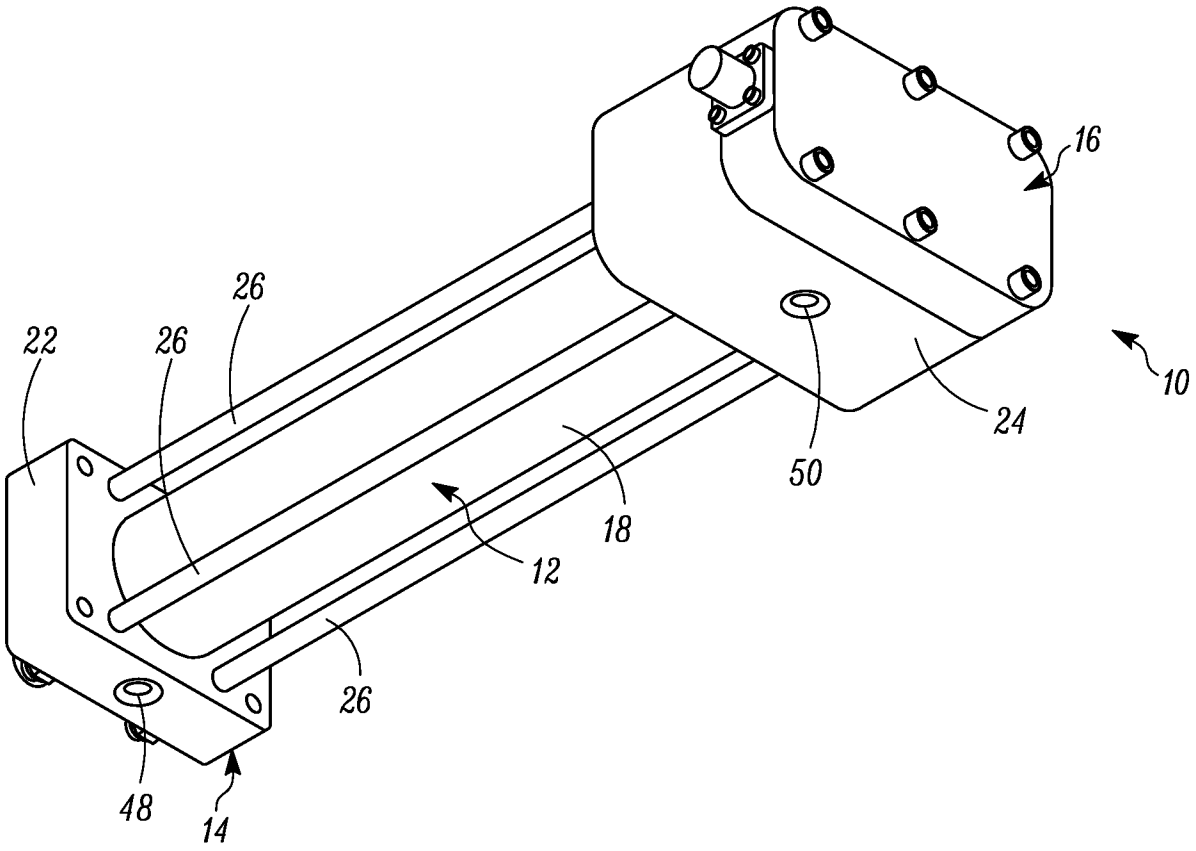
FIG. 1 is a perspective view of one embodiment of a fail-safe hydraulic actuator described herein.
Figure 2:
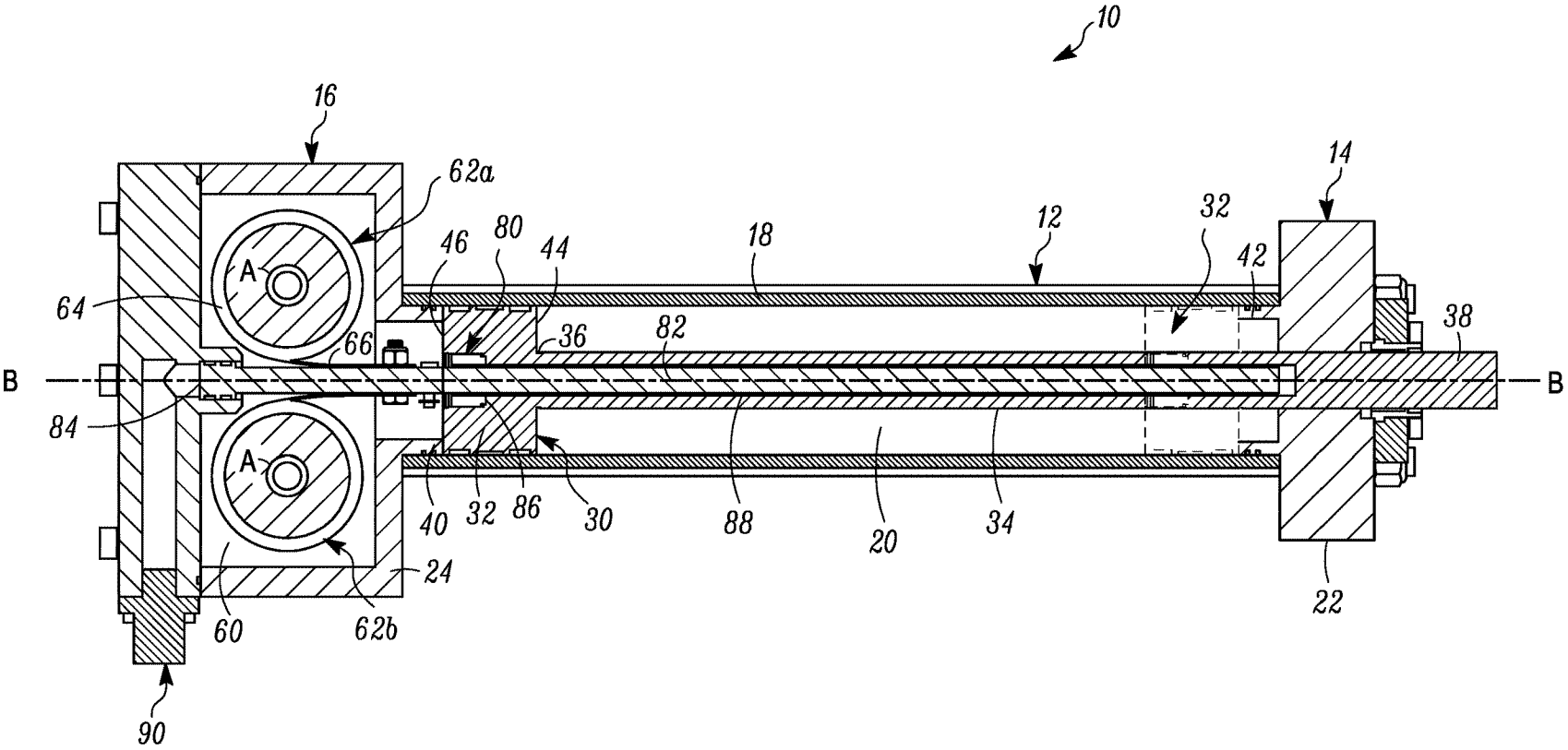
FIG. 2 is a longitudinal cross-sectional view of the fail-safe hydraulic actuator of FIG. 1.

Referring initially to FIGS. 1 and 2, an example construction of a fail-safe hydraulic actuator 10 is illustrated. In this example, the actuator 10 includes a housing 12 having a first end 14 and a second end 16. The housing 12 includes a central portion 18 that can be, for example, cylindrical in shape, and that is open at both ends thereof and that is substantially hollow to define a piston chamber 20. A removable cap 22 at the first end 14 closes, in liquid-tight manner, one open end of the central portion 18. A combined hydraulic fluid cavity/constant force retraction spring mechanism housing 24 is removably disposed at the second end 16 and closes, in liquid-tight manner, the opposite open end of the central portion 18. As seen in FIG. 1, a plurality of tie rods 26, for example four of the tie rods 26 (only three of the tie rods 26 are visible in FIG. 1), can extend between the removable cap 22 and the housing 24 to help secure the cap 22 and the housing 24 to the central portion 18 and to add rigidity to the actuator 10. In some embodiments, the actuator 10 may be used underwater in which case the housing 12 is sealed and water-tight to prevent ingress of water into the housing 12. The housing 12 is also appropriately sealed to prevent leakage of hydraulic fluid from the housing 12.

Referring to FIG. 2, a piston assembly 30 is disposed within the piston chamber 20. The piston assembly 30 includes a piston 32 that is slidably disposed within the piston chamber 20 in sealing engagement with the walls thereof, and a piston rod 34 that is connected to the piston 32 and therefore moves with the piston 32. The piston rod 34 has one end 36 that is connected to one side of the piston 32 and an opposite end 38 of the piston rod 34 extends through the cap 22 at the first end 14 of the housing 12 so that the end 38 projects from the housing 12. FIG. 2 shows the piston 32 in a home or fully retracted position. In this home position, the left side of the piston 32 can abut against a suitable stop mechanism, for example an end 40 of the housing 24. The piston 32 is actuatable to a maximum or fully extended position, shown in dashed lines in FIG. 2, where the right side of the piston 32 can abut against a suitable stop mechanism, for example an end 42 of the cap 22.

With continued reference to FIG. 2, the piston 32 has a first pressure face 44 and a second pressure face 46. By applying pressurized hydraulic fluid to either the first pressure face 44 or the second pressure face 46, movement of the piston 32 and the piston rod 34 can be controlled. Hydraulic fluid can be introduced into the piston chamber 20 to contact the pressure face 44 to force the piston 32 toward the left in FIG. 2 via a port 48 (seen in FIG. 1) formed in the cap 22. The hydraulic fluid can also exit through the port 48 when the piston 32 moves in the opposite direction. Hydraulic fluid can be introduced into the piston chamber 20 to contact the pressure face 46 to force the piston 32 toward the right in FIG. 2 via a port 50 (seen in FIG. 1) formed in the housing 24. The hydraulic fluid can also exit through the port 50 when the piston 32 moves in the opposite direction.

The housing 24 defines a hydraulic fluid cavity 60 that is configured to contain a hydraulic fluid. The cavity 60 is in fluid communication with the port 50 and is also in fluid communication with the piston chamber 20 to allow passage of hydraulic fluid between the hydraulic fluid cavity 60 and the piston chamber 20 so that the pressurized hydraulic fluid can engage the second pressure face 46. The cavity 60 is also large enough in size to accommodate at least one, for example two or more, constant force retraction spring mechanisms 62*a*, 62*b*. The actuator 10 is illustrated as including two of the constant force retraction spring mechanisms 62*a*, 62*b*. However, in some embodiments, a single constant force retraction spring mechanism may be used. Also, in some embodiments, more than two of the constant force retraction spring mechanisms may be used.

Figure 3:
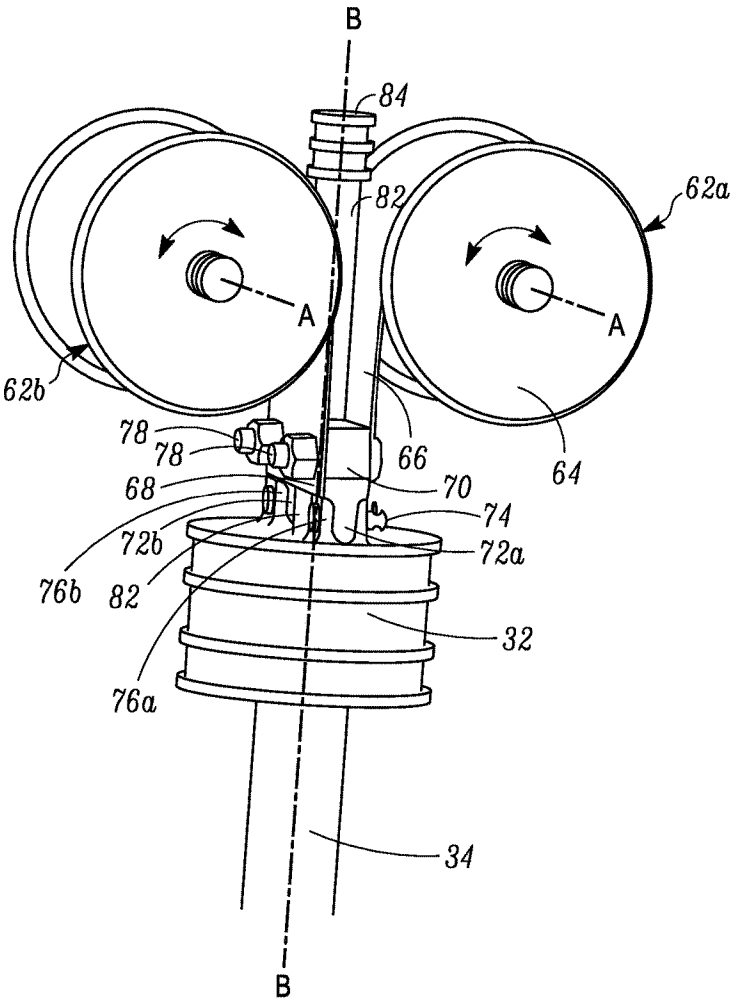
FIG. 3 is a detailed view of a portion of the fail-safe hydraulic actuator showing an example of a connection between the constant force retraction springs and the piston.

The constant force retraction spring mechanisms 62*a*, 62*b* are identical in construction and therefore only the constant force retraction spring mechanism 62*a* is described in detail. Referring to FIGS. 2 and 3, the constant force retraction spring mechanism 62*a* includes a rotatable spool 64 and a constant force retraction spring 66. The spool 64 is freely rotatably mounted in the cavity 60 for rotation about a rotation axis A that is perpendicular to a longitudinal axis B-B of the actuator 10 and of the housing 12. The constant force retraction spring 66 is a strip-like structure that has a first end connected to the spool 64 and a second, opposite end 68 that is fixed to the piston assembly 30. In the illustrated embodiment, the end 68 of the spring 66 is fixed to the piston 32 on the second pressure face 46 side of the piston 32 opposite the side where the piston rod 34 is connected to the piston 32.

The end 68 of the spring 66 can be fixed to the piston 32 in any suitable manner so that the spring 66 moves with the piston 32. Referring to FIG. 3, in the illustrated example, a clevis structure 70 has two spaced arms 72*a*, 72*b* projecting toward the piston 32 that are fixed by fasteners 74 to two pairs of ears 76*a*, 76*b* projecting from the piston 32 toward the cavity 60. The ends 68 of the two springs 66 are disposed on opposite sides of the clevis structure 70 and are fixed to the clevis structure 70 by fasteners 78.

In operation of the actuator 10 described so far, referring to FIG. 2, the piston 32 is actuated to the right away from the home or fully retracted position shown in solid lines in FIG. 2 in order to actuate a structure that is connected to the piston rod 34. This actuation occurs by increasing the pressure of the hydraulic fluid acting on the second pressure face 46 of the piston 32, while allowing hydraulic fluid on the other side of the piston to escape from the chamber 20 via the port 48. As the piston 32 moves to the right in FIG. 2, the constant force retraction springs 66 unwind from the spools 64 and apply a constant bias force acting on the piston 32 to bias the piston 32 back toward the home or fully retracted position. In the event of loss of hydraulic pressure, the constant force retraction springs 66 will retract the piston 32 back toward the home or fully retracted position with the springs 66 being rewound back onto the spools 64.

In addition, because the constant force retraction spring mechanisms 62*a*, 62*b* are disposed within the hydraulic fluid cavity 60 and within the hydraulic fluid contained therein, the constant force retraction spring mechanisms 62*a*, 62*b* are protected from the environment surrounding the actuator 10, for example sea water if the actuator 10 is used underwater.

The actuator 10 may also include a sensor that detects the linear position of the piston 32 within the piston chamber 20 (i.e. the position of the piston 32 along the longitudinal axis B-B). The sensor, described in further detail below, can be used together with the features of the actuator 10 discussed above with or without the constant force retraction spring mechanisms 62*a*, 62*b*, or the sensor can be used in an actuator having a different construction.

Referring initially to FIG. 2, the sensor includes a magnet 80 that is mounted on the piston assembly 30, for example on the piston 32, and moves therewith. Alternatively, the magnet 80 can be mounted on the piston rod 34. The sensor also includes an elongated, linear sensor rod 82 that has an end 84 that is fixed to the second end 16 of the housing 12 so that the rod 82 is fixed in position. There are sensors (not shown) housed in the rod 82. When the magnet 80 passes over the sensors, the sensors read the position of the magnet 80. Suitable sensors having this kind of construction are available from Rota Engineering, Ltd. of the United Kingdom.

The magnet 80 is ring-shaped and is mounted at the inner diameter of the piston 32 within a central opening 86 of the piston 32 so that the magnet 80 surrounds the elongated, linear sensor rod 82 which extends through the central opening 86.

In addition, the piston rod 34 includes a central cavity 88 that is aligned with the central opening 86. The sensor rod 82 extends through the hydraulic fluid cavity 60, through the central opening 86 and into the central cavity 88. In the illustrated embodiment, the central cavity 88 extends the majority of the length of the piston rod 34, and the sensor rod 82 extends the majority of the length of the central cavity 88 when the piston 32 is at the home position shown in solid lines in FIG. 2. In addition, the sensor rod 82 extends between the spools 64 and the springs 66 of the first and second constant force retraction spring mechanisms 62*a*, 62*b*. Electrical energy for the sensor and sensor readings are provided through a sensor connector 90 at the second end 16 of the housing 12.

In operation of the sensor, as the piston 32 moves, the movement of the magnet 80 and its position relative to the sensor rod 82 is detected by the sensors in the sensor rod 82.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A fail-safe hydraulic actuator, comprising:

a housing having a first end and a second end and defining a piston chamber;

a piston assembly that includes a piston slidably disposed within the piston chamber and a piston rod connected to the piston and movable with the piston, the piston rod having an end thereof that extends through the first end of the housing;

the housing includes a hydraulic fluid cavity adjacent to the second end thereof, the hydraulic fluid cavity is configured to contain a hydraulic fluid, and the hydraulic fluid cavity is in fluid communication with the piston chamber to allow passage of hydraulic fluid between the hydraulic fluid cavity and the piston chamber; and at least first and second constant force retraction spring mechanisms mounted within the hydraulic fluid cavity, the first and second constant force retraction spring mechanisms each include a constant force retraction spring having an end fixed to the piston assembly.

2. The fail-safe hydraulic actuator of claim 1, wherein each of the constant force retraction springs has another end that is connected to a spool of the respective first and second constant force retraction spring mechanisms, and the spools are rotatably mounted within the hydraulic fluid cavity.

3. The fail-safe hydraulic actuator of claim 2, wherein the housing has a longitudinal axis, and the spools of the first and second constant force retraction spring mechanisms are rotatable about axes that are perpendicular to the longitudinal axis.

4. The fail-safe hydraulic actuator of claim 2, further comprising a sensor that detects linear position of the piston within the piston chamber.

5. The fail-safe hydraulic actuator of claim 4, wherein the sensor comprises a magnet mounted on the piston and movable therewith, and an elongated, linear sensor rod that has an end that is fixed to the second end of the housing.

6. The fail-safe hydraulic actuator of claim 5, wherein the magnet is ring-shaped; and the magnet and the elongated, linear sensor rod are arranged relative to each other such that the magnet surrounds the elongated, linear sensor rod.

7. The fail-safe hydraulic actuator of claim 5, wherein the piston includes a central opening and the piston rod includes a central cavity that is aligned with the central opening; and the elongated, linear sensor rod extends through the hydraulic fluid cavity, through the central opening and into the central cavity.

8. The fail-safe hydraulic actuator of claim 7, wherein the central cavity extends the majority of the length of the piston rod, and the elongated, linear sensor rod extends the majority of the length of the central cavity when the piston is at a retracted home position.

9. The fail-safe hydraulic actuator of claim 1, wherein the ends of the constant force retraction springs are fixed to the piston on a side of the piston opposite of where the piston rod is connected to the piston.

10. The fail-safe hydraulic actuator of claim 7, wherein the elongated, linear sensor rod extends between the spools of the first and second constant force retraction spring mechanisms.

11. The fail-safe hydraulic actuator of claim 1, wherein the housing is sealed and water-tight to prevent ingress of water into the housing when the fail-safe hydraulic actuator is used underwater.

12. A fail-safe hydraulic actuator, comprising:

a housing having a first end and a second end and defining a piston chamber;

a piston assembly that includes a piston slidably disposed within the piston chamber and a piston rod connected to the piston and movable with the piston, the piston rod having an end thereof that extends through the first end of the housing;

the housing includes a hydraulic fluid cavity that is configured to contain a hydraulic fluid and that is in fluid communication with the piston chamber to allow passage of hydraulic fluid between the hydraulic fluid cavity and the piston chamber;

at least first and second constant force retraction spring mechanisms, the first and second constant force retraction spring mechanisms each include a constant force retraction spring having an end fixed to the piston on a side of the piston opposite of where the piston rod is connected to the piston;

a sensor that detects linear position of the piston within the piston chamber.

13. The fail-safe hydraulic actuator of claim 12, wherein the sensor comprises a magnet mounted on the piston and movable therewith, and an elongated, linear sensor rod that has an end that is fixed to the second end of the housing.

14. The fail-safe hydraulic actuator of claim 13, wherein the magnet is ring-shaped; and the magnet and the elongated, linear sensor rod are arranged relative to each other such that the magnet surrounds the elongated, linear sensor rod.

15. The fail-safe hydraulic actuator of claim 13, wherein the piston includes a central opening and the piston rod includes a central cavity that is aligned with the central opening; and the elongated, linear sensor rod extends through the hydraulic fluid cavity, through the central opening and into the central cavity.

16. The fail-safe hydraulic actuator of claim 15, wherein the central cavity extends the majority of the length of the piston rod, and the elongated, linear sensor rod extends the majority of the length of the central cavity when the piston is at a retracted home position.

17. The fail-safe hydraulic actuator of claim 13, wherein each of the constant force retraction springs has another end that is connected to a spool of the respective first and second constant force retraction spring mechanisms, and the linear sensor rod extends between the spools of the first and second constant force retraction spring mechanisms.

* * * * *